US005845808A

United States Patent [19]

Kani

[11] Patent Number: 5,845,808

[45] Date of Patent: Dec. 8, 1998

[54] DISPOSABLE STERILIZED FLUID CONTAINER

[75] Inventor: Koji Kani, Kagamihara, Japan

[73] Assignee: Nikko Confectionery Co., Ltd., Gifu-ken, Japan

[21] Appl. No.: 859,354

[22] Filed: May 20, 1997

[51] Int. Cl.[6] ..... B65D 25/00

[52] U.S. Cl. ..... 220/710; 220/705; 220/745; 215/389; 215/399

[58] Field of Search ..... 220/710, 705, 220/745; 215/389, 399, 902

[56] References Cited

U.S. PATENT DOCUMENTS

| | | | |
|---|---|---|---|
| 4,982,854 | 1/1991 | Ichimiya | 220/710 |
| 5,078,286 | 1/1992 | Hashimoto | 220/710 |
| 5,280,844 | 1/1994 | Kaufman et al. | 220/710 |
| 5,353,955 | 10/1994 | Kaufman et al. | 220/710 |
| 5,385,265 | 1/1995 | Kaufman et al. | 220/710 |
| 5,409,124 | 4/1995 | Nasrallah et al. | 220/710 |
| 5,437,389 | 8/1995 | Kaufman et al. | 220/710 |

*Primary Examiner*—Joseph M. Moy
*Attorney, Agent, or Firm*—Hazel & Thomas

[57] ABSTRACT

A fluid container molded from a plastic material according to the present invention is embodied in a disposable, single-use, sterilized fluid container for beverages or fluids parentally or controllably taken by human beings. The fluid container may be manufactured, storable and transportable in simplified manner, facilitating consumption of the fluid contents, and administrable with additional solutions and/or water so that it can be used as a container for non-parenteral or direct gastrointestinal infusion.

3 Claims, 1 Drawing Sheet

DISPOSABLE STERILIZED FLUID CONTAINER

FIELD OF THE INVENTION

This invention relates to a fluid container molded from a plastic material and in particular a disposable, single-use, sterilized fluid container for beverages or fluids parentally or controllably taken by human beings.

BACKGROUND OF THE INVENTION

A fluid container having a filling tube member that can be pushed into the container was disclosed in U.S. Pat. No. 5,078,286 to K. Hashimoto. Specifically, the filling tube member projects from the container to facilitate filling the container with a content fluid. After completion of the filling operation, the tube is thermally sealed off and at least inverted and pushed into the container interior. This smooths the contour of the container into a rounded or rectangular cylindrical shape without a substantial projection which would otherwise hinder space-saving storage and transportation. The container of this prior art type is provided with a straw member communicating with the container interior and extending along the side thereof for facilitating consumption of the content fluid.

The prior art container is not suited to fluid to be consumed by patients or invalids who are not strong enough to pressurize the container by pressing the plastic container from the outside and/or sucking up through the straw member in order to drink the fluid from the container through the straw member. Absence of a vent from the prior art container makes it difficult for patients and physically weak persons to consume the fluid content from the container. The straw member of the prior art container, after the start of consumption of the fluid content, has a distal end that remains open even during interruption of the consumption which may then cause outflow of the contents and/or ingress of contaminants therethrough. Consequently, the prior art containers are not supplied to hospitals and clinics.

It is not practical to replenish or supply additional medicaments, nutrients and/or water to the fluid contained and sealed in this type of prior art containers.

SUMMARY OF THE INVENTION

The objects of the invention are, in general, to provide a fluid container that is manufactured, storable and transportable in simplified manner, that facilitates consumption of the fluid content, and that is administrable with additional solutions and/or water so that it can be used as a container for non-parenteral or controlled/direct gastrointestinal infusion.

According to one feature of this invention, a container main body has a filling tube means at least partially pushable into the container interior. The filling tube member projects from the container, according to this disclosed invention, for facilitating filling the container with a content fluid. After completion of the filling operation the tube is thermally sealed off and at least inverted and pushed into the container interior. This will smooth the contour of the container into a rounded or rectangular cylindrical shape without a substantial projection that would otherwise hinder space-saving storage and transportation. Thus, the use of bulky or excessive storage space for shelving and transportation may be avoided.

According to another feature of the invention, the container main body has a straw member communicating with the container interior and extending along one side of the container, whereby inadvertent outflow of the fluid content may be prevented even when a bed-ridden person drinks the content from the container with or without ambient vibration.

According to still other feature of the invention, the container main body has a hooking projection disposed on the other face thereof, whereby the container can be suspended from a hook hanger so that patients can be freed from having to support the container themselves during consumption of the content fluid from the container.

According to a separate aspect of the invention, the container main body has a bulging section adapted to being partially cut open and that communicates with the container interior so that the cut-open bulging section may give access to the container interior for replenishing or supplying water and/or additional medicament solutions or tablets into the container.

According to another aspect of the invention, the container main body a cap member detachable from the container main body and adapted to form an air vent opening in the container main body upon being detached from said main body. The vent permits the supplying of air into the container interior, thereby helping the drinking or consuming the fluid content by a patient.

The size of the air vent opening may be adjusted to permit the container to be used as a source reservoir for non-parenteral or direct gastrointestinal infusion of a solution.

When the cap member is detached from the container main body, the cap member itself has an opening which can be mounted with the distal end of the straw member. When fluid consumption from the container is interrupted, the cap member can be capped onto the straw member whereby the fluid content then remaining can be prevented from inadvertently outflowing and protected from ingress of possible contaminants.

According to still another feature of the invention, the container main body has a member of spaced metering stripes extending in a slanting direction as viewed when the container is postured vertically, so that the metering stripes or indicia may be viewed in a horizontal direction since the container is slantingly positioned when suspended from a hanger.

BRIEF DESCRIPTION OF THE DRAWINGS

The invention will now be described in connection with the accompanying drawings, in which.

DETAILED DESCRIPTION OF THE PREFERRED EMBODIMENTS

Figure 1:
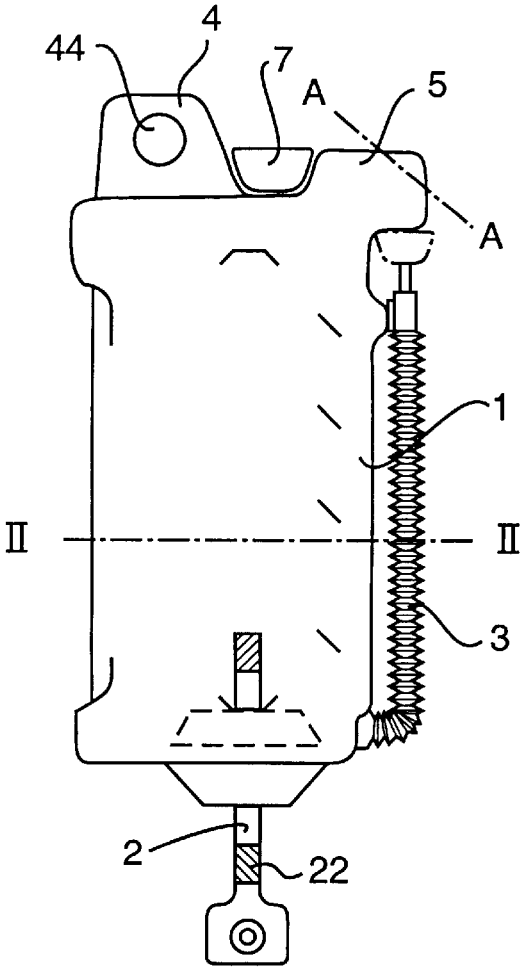
FIG. 1 illustrates a side view of a fluid container in accordance with the present invention.
Figure 2:
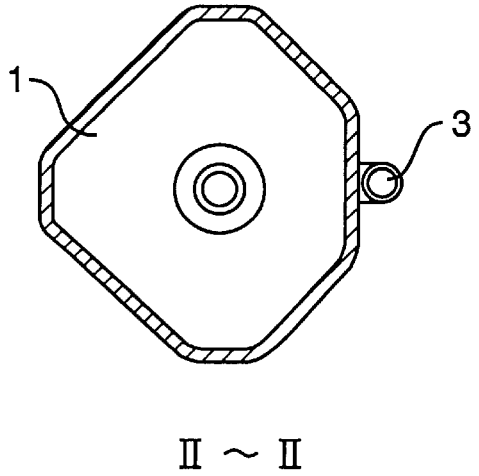
FIG. 2 is a sectional view taken along lines II—II of FIG. 1.

Referring to FIG. 1 there is shown a fluid container 1 blow-molded from a synthetic resin material and having an overall cross-sectionally rectangular cylindrical shape having a filling tube member 2 provided centrally in the lower side thereof. Upon filling the container 1, the container main body is turned upside down with the filling tube member 2 on the upper side thereof.

The filling tube 2 is cut off before the filling step. The fluid container 1 is filled via the filling tube 2. Subsequently, the filling tube 2 is thermally sealed at 22 and then into a position shown by the broken lines in the interior of the fluid container 1.

A straw member 3 extends along the one side of the fluid container 1 and has a bellows cylindrical wall. The straw member 3 communicates with the interior of the fluid container 1 at its proximal end and is closed adjacent its distal end. The closure of the distal end of the straw member 3 may be broken so as to open the distal end thereof. Thus, the distal end may be placed in the mouth for consumption of the fluid content of the fluid container 1. In other words, the distal end of the straw member is breakably closed before consumption of the container contents and may be broken upon use of the contents.

The fluid container 1 has a hooking projection 4 located on an upper face close to the one side thereof. The projection 4 is formed with an aperture 44 through which a hook on a hospital hanger B (such as a rack used in conjunction with the administration of intravenous fluids) extends to place the container in a suspended condition.

The main body of the fluid container 1 is formed with a bulging section 5 located on the upper face close to the other side thereof. It communicates with the interior of the fluid container 1. The section can be cut along line A—A to form an opening through which additional medical solutions or tablets can be fed into the container interior when the container 1 is suspended for use. Water can be poured thereinto from a pitcher.

Figure 4:
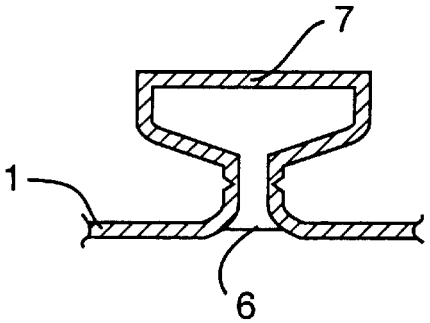
FIG. 4 illustrates a sectional view of a cap member of the fluid container of FIG. 1.

A cap member 7 is located centrally on the upper face of the body of container 1. As shown in detail in FIG. 4, it is connected through a thin-walled portion to the container body. It is thus apparent that a small opening 6 is formed when the cap member is detached from the container body. The small opening 6 acts as an air vent allowing a substantially equal volume of air to flow into the interior of the fluid container 1 as that of the dispensed fluid content so that the fluid content can be easily consumed through the straw member 3 by patients, the invalid or infants without having to pressingly deform the container. This is unlike the prior art which requires nominal force exerted for consumption of the content.

The small opening 6 can be adjusted to a suitable size or diameter which limits the rate of in-flowing air and, accordingly, the rate of which the fluid contents are supplied to the consumer. Thus, the fluid container 1 of the present invention can be used as a source reservoir for non-parenteral or direct gastrointestinal infusion of a solution.

An opening formed in the cap member 7 when the cap member 7 is detached from the container body 1 matingly corresponds in size to the opening of the distal end of the straw member 3, so that the cap member 7 may be capped onto the distal end of the straw member 3.

Figure 3:
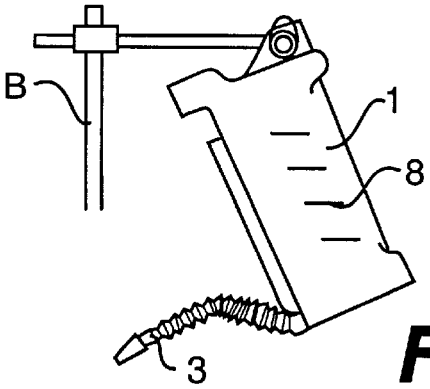
FIG. 3 shows a side view of a fluid container according to the present invention as suspended from a hanger in use.

The fluid container 1 has a number of metering stripes 8, spaced in the vertical direction thereof. Each of the metering stripes 8 extends in a slanting direction as viewed when the container 1 is vertically positioned as shown in FIG. 1. When the fluid container 1 is suspended on a hanger B in use, as shown in FIG. 3, the container itself extends slantingly with the metering stripes or indicia in a horizontal direction. In other words, the metering stripes 8 extend in parallel with the upper surface of the fluid contents that run horizontally when the container is in use. This ensures easy and correct reading of the remaining volume of the fluid contents in the container 1.

While the invention has been described in conjunction with one of its preferred embodiments, it should be understood that changes and modifications may be made without departing from the spirit and scope of the appended claims.

What is claimed is:

1. A fluid container comprising:

a substantially elongate container main body;

means for filling contents into said fluid container located in one face of said container main body and adapted to being at least partially pushed into an interior space of said container main body for closing said filling means;

a straw member extending along one side of said container main body and communicating with the interior space of said container main body;

a hooking projection disposed in another face of said container main body;

a bulging section adapted to being partially cut open and communicating with the interior space of said container main body; and a cap member detachably formed on the container main body and adapted to define an air vent opening in the container main body when detached from said main body.

2. The fluid container of claim 1 wherein said cap member can be fitted on a distal end of said straw member after being detached from said main body.

3. A fluid container of claim 1 further comprising a plurality of spaced metering stripes formed on the main body that extend in a slanting direction as viewed when said main body is vertically postured.

* * * * *